United States Patent [19]

Nishimura et al.

[11] Patent Number: 4,854,006

[45] Date of Patent: Aug. 8, 1989

[54] FLOOR NOZZLE FOR VACUUM CLEANER

[75] Inventors: Hiroshi Nishimura, Gamou; Yasutaka Hirayama, Kouka, both of Japan

[73] Assignee: Matsushita Electric Industrial Co., Ltd., Kadoma, Japan

[21] Appl. No.: 174,922

[22] Filed: Mar. 29, 1988

[30] Foreign Application Priority Data

Mar. 30, 1987 [JP] Japan ..... 62-76756
Mar. 30, 1987 [JP] Japan ..... 62-76757

[51] Int. Cl.[4] ..... A47L 5/30

[52] U.S. Cl. ..... 15/375; 15/42; 15/421

[58] Field of Search ..... 15/416, 42, 378, 421, 15/376, 375

[56] References Cited

U.S. PATENT DOCUMENTS

| | | | |
|---|---|---|---|
| 1,560,400 | 11/1925 | Uander Putten | 15/375 X |
| 1,587,794 | 6/1926 | O'Brien | 15/375 X |
| 3,936,903 | 2/1976 | Johnson | 15/416 X |
| 3,942,219 | 3/1976 | Johnson | 15/416 X |
| 4,022,234 | 5/1977 | Martinec et al. | 15/416 X |
| 4,219,902 | 9/1980 | De Maagd | 15/420 X |
| 4,222,146 | 9/1980 | Hertzberg | 15/42 X |
| 4,355,436 | 10/1982 | Hertzberg | 15/42 X |

FOREIGN PATENT DOCUMENTS

| | | |
|---|---|---|
| 7018880 | 7/1971 | Fed. Rep. of Germany . |
| 3012685 | 4/1980 | Fed. Rep. of Germany . |
| 6032456 | 7/1980 | Japan . |
| 2019715 | 11/1979 | United Kingdom . |

*Primary Examiner*—Chris K. Moore
*Attorney, Agent, or Firm*—Cushman, Darby & Cushman

[57] ABSTRACT

A floor nozzle for vacuum cleaner in addition to a main rotating brush has auxiliary rotating brushes positioned aperatures in the side faces of the nozzle which extend to the bottom thereof, thereby to brush and suck dusts of edges on a carpet adjacent a wall of a room.

13 Claims, 9 Drawing Sheets

FLOOR NOZZLE FOR VACUUM CLEANER

FIELD OF THE INVENTION AND RELATED ART STATEMENT

1. Field of the Invention

The present invention relates to a vacuum cleaner having a floor nozzle with rotating brushes.

2. Description of the Related Art

Since it has been difficult to perfectly suck dusts on a carpeting etc. (hereinafter is merely referred as a carpet) to be cleaned by only suction air flow from a simple passive floor nozzle by a fan motor of a vacuum cleaner, a floor nozzle having one or plural rotating brushes has been used in order to improve sucking ability for the carpet. These rotating brushes actively brush the carpet thereby to remove the dusts from piles of the carpet, so that the dusts are carried together with sucking air to a dust bag of the vacuum cleaner. This conventional floor nozzle of the vacuum cleaner comprises a nozzle at the bottom of a nozzle case, rotating brushes in the nozzle case which project slightly out of the mouth, and a motor or an air turbine as driving means for the rotating brushes. Since both end portions of the shaft of the rotating brushes are rotatably held by bearings in the nozzle case, there exist regions having no brush in both end parts of the bottom of the nozzle case. Therefore, it is difficult to brush edges of a carpet adjacent the wall of a room, and the carpet cannot be cleaned perfectly. In order to overcome the above-mentioned shortcomings, auxiliary rotating brushes have been provided connected with each end of the shaft of the rotating brushes. However, since these auxiliary rotating brushes are still inside the nozzle case, the edges of the carpet still cannot be cleaned perfectly.

OBJECT AND SUMMARY OF THE INVENTION

The object of the present invention is to provide an improved floor nozzle for a vacuum cleaner which is capable of sucking dusts even on any edges and corners of the carpet to be cleaned which are adjacent a wall.

In order to achieve the above-mentioned object, a floor nozzle for a vacuum cleaner in accordance with the present invention comprises:

- a nozzle case having a nozzle mouth on the bottom thereof, an aperture which is formed in at least one side face of the nozzle case and extends to the bottom of that face and a suction compartment in the case;
- driving means;
- a main brush which is rotated by the driving means in the suction compartment and tips of which are projected out of the nozzle mouth; and
- at least one auxiliary brush which is connected to an end of the main brush and positioned in the aperture.

The above-mentioned floor nozzle for a vacuum cleaner can clean up a carpet completely without any dusts remaining on edges and corners thereof adjacent a wall.

DESCRIPTION OF THE PREFERRED EMBODIMENT

Figure 1:
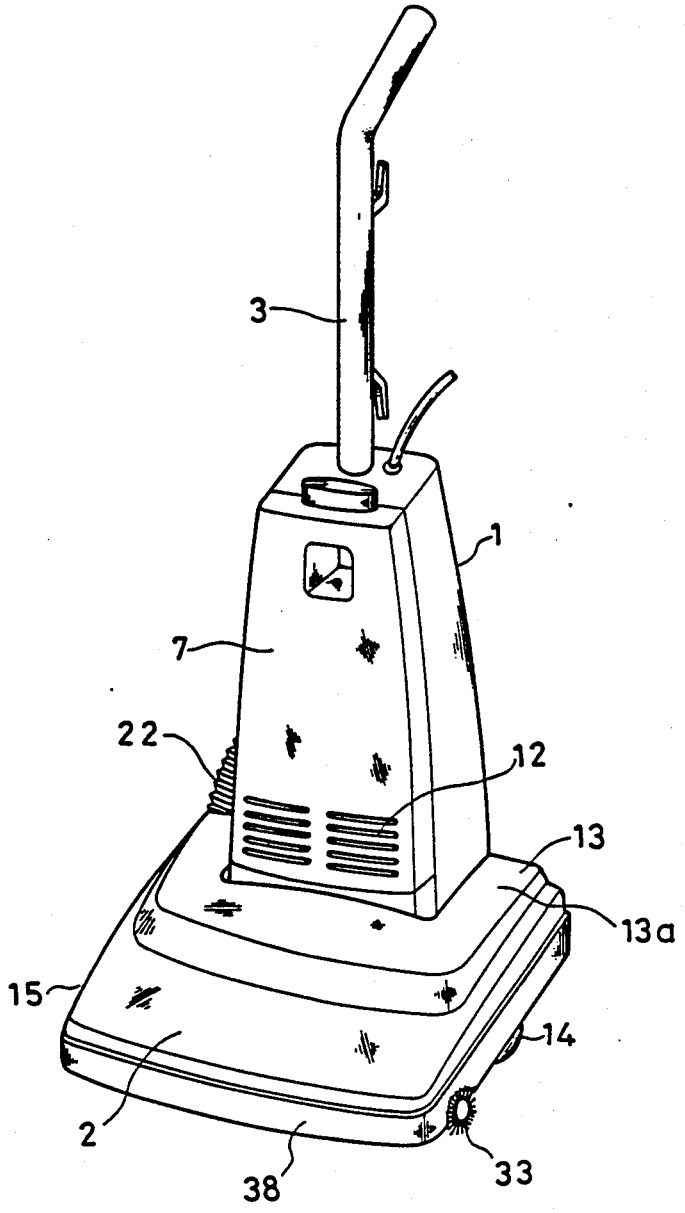
FIG. 1 is a perspective view showing a vacuum cleaner which has a floor nozzle of an embodiment of the present invention.
Figure 2:
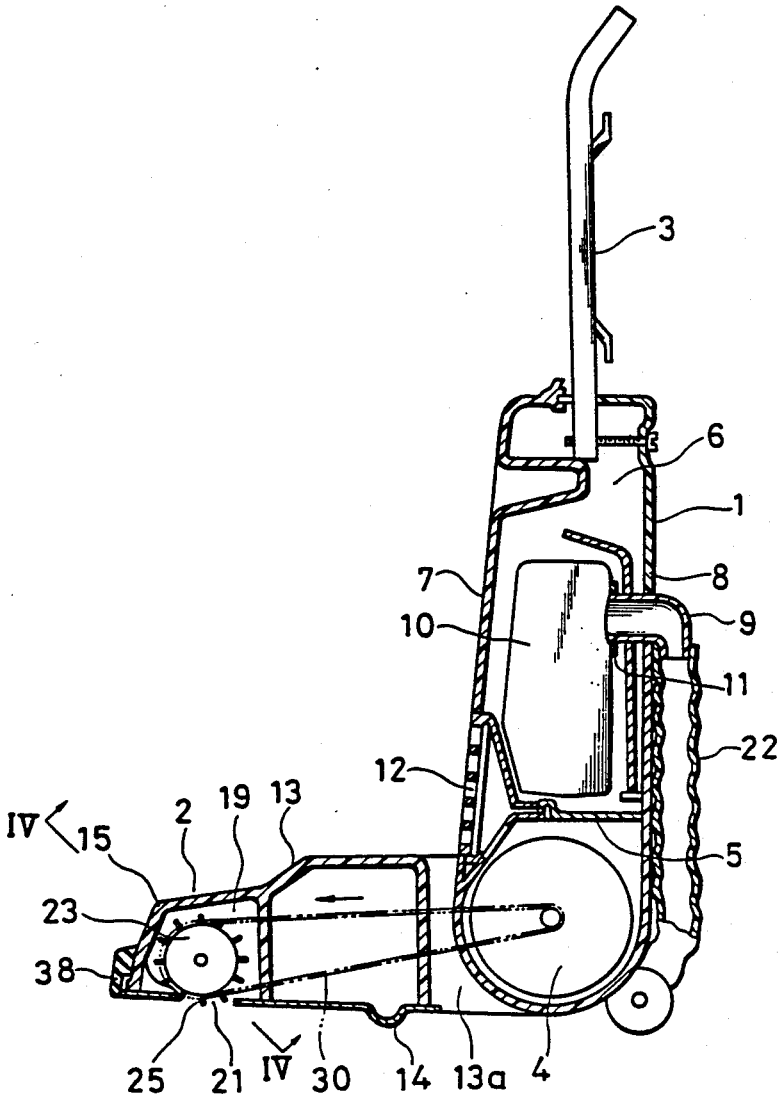
FIG. 2 is a vertical sectional view of the cleaner shown in FIG. 1.
Figure 3:
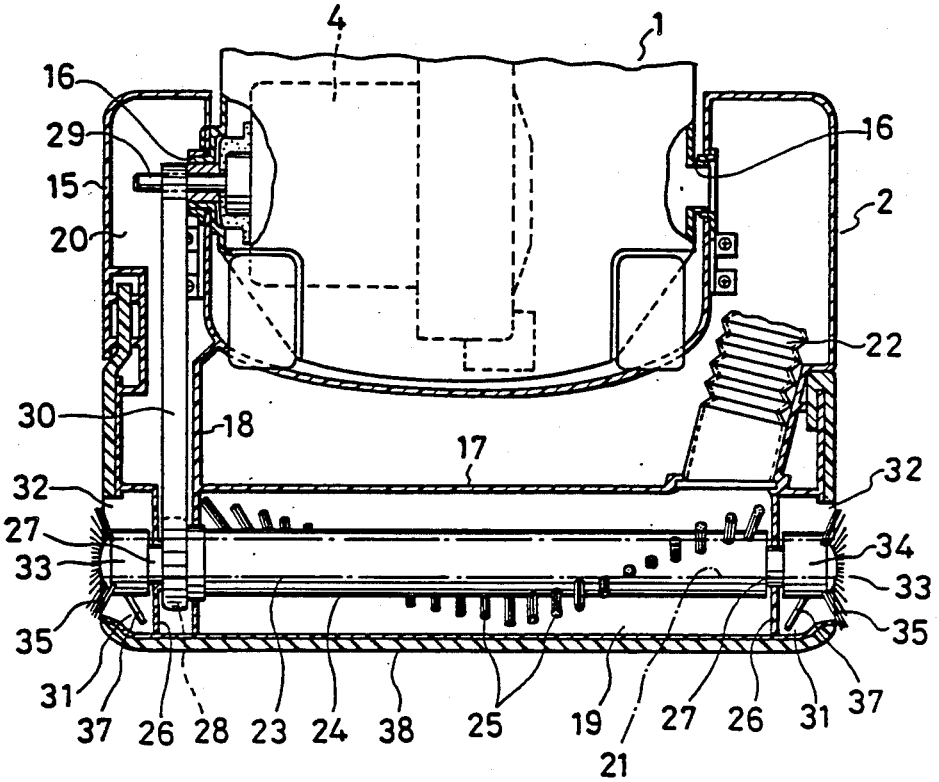
FIG. 3 is a horizontal sectional view of the floor nozzle of the cleaner shown in FIG. 2.
Figure 4:
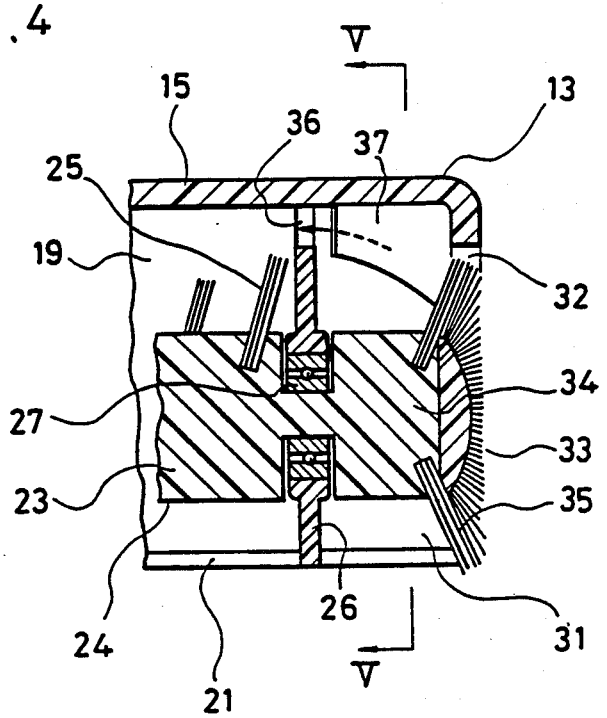
FIG. 4 is an enlarged fragmentary sectional view taken on the line IV—IV shown in FIG. 2.
Figure 5:
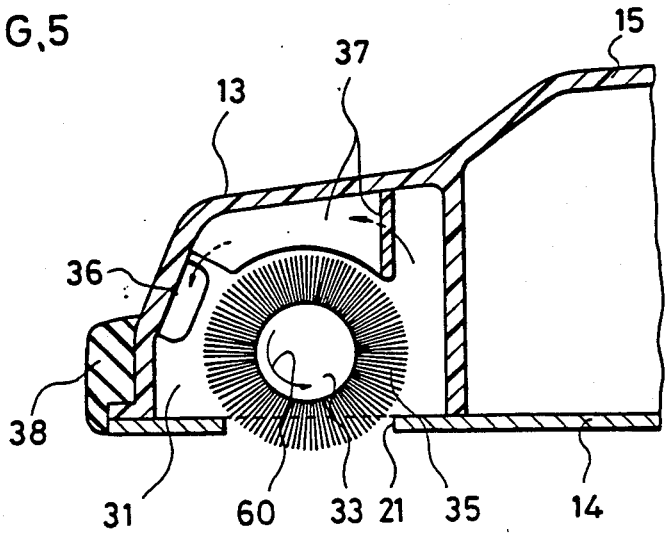
FIG. 5 is a sectional view taken on the line V—V shown in FIG. 4.

Hereafter, a preferred embodiment of the present invention is described with reference to the accompanying drawings. Referring now to FIGS. 1–5 there is shown a floor nozzle 2 pivotally secured to the body 1 of a vacuum cleaner. The body 1 has a handle 3, which extends upward, and a fan motor 4 therein. An air-permeable partition 5 sections the inner space of the body 1 to form a dust catching compartment 6 at a suction side of the fan motor 4 in the upper portion of the body 1. The dust catching compartment 6 can be opened by detaching a front cover 7 from the body 1. A suction pipe 9 penetrates through a rear panel 8 of the dust catching compartment 6 and is fixed therein. An opening 11 of a dust filter bag 10 is connected with the discharge end of the suction pipe 9 within the dust catching compartment 6. Plural slits 12 are formed in the body 1 in order to exhaust air from the fan motor 4. In the floor nozzle 2, the nozzle case part 15 is formed by coupling an upper case 13 and a lower case part 14. A rear part 13*a* of the part 13 is formed into a concave configuration so as to surround the front and both sides of the lower part of the body 1, and is pivotally secured thereto by stub shaft 16 (FIG. 3). The inner space of the nozzle case 15 is sectioned into a suction compartment 19 and a belt compartment 20 by partitions 17 and 18. As shown in FIG. 2, the suction compartment 19 is connected to a generally rectangular downward facing nozzle mouth 21, which extends transversely or laterally in the lower part 14. The dust filter bag 10 is connected to the suction compartment 19 via a hose 22 which is connected at one end to the partition 17 (FIG. 3) and at the other end to the suction pipe 9 (FIG. 2). As shown in FIG. 3, a main rotating brush 23 comprises a cylindrical rotor 24 and plural brushes 25 which are spirally arranged thereon. Both reduced end portions of the rotor 24 are held in supporting walls 26 via bearings 27. The tips of the brushes 25 slightly project out of the nozzle mouth 21 in order to brush the carpet to be cleaned. The main brush is rotated by a pulley 28 fixed to one end portion of the rotor 24 in the belt compartment 20 and driven by a belt 30 trained over the pulley 28 and a spindle 29 of the fan motor 4 which projects into the belt compartment 20 through the shaft 16. Side compartments 31 are formed in the nozzle case 15 at both ends of the main rotating brush 23. The bottom part of each compartment 31 is open to the nozzle mouth 21 (FIG. 2) and each side of the case 15 is apertured, as at 32, to communicate the compartments 31 with the exterior of the case. The end portions of the rotor 24 extend beyond the walls 26 into the compartments 31 and have auxiliary rotating brushes 33 carried thereon. The brushes 33 comprise cylindrical rotors 34 and plural brushes 35 mounted thereon and arranged in a conical configuration that projects slightly outward of the corresponding aperture 32 which conforms circularly to that configuration. FIG. 5. FIG. 5 As shown in the main rotating brush 23 and the auxiliary rotating brushes 33 are rotated in the direction shown by an arrow 60 to thereby brush the dusts on the carpet up into the suction compartment 19. Each supporting wall 26 has a vent 36 for admitting the dusts in the corresponding side compartment 31 into the suction compartment 19 and a curved guide wall 37 is positioned in the upper part of each side compartment 31 for smoothly guiding the dusts therein to the corresponding vent 36. A protective rubber bumper 38 surrounds the sides of the floor nozzle 2.

In a cleaning operation, by rotating the main rotating brush 23 and the auxiliary rotating brushes 33 together with the fan motor 4, the dusts on a carpet are sucked by the fan motor 4 through the nozzle mouth 21 into the compartment 31. The air containing the dusts flows from the suction compartment 19 through the hose 22 and the suction pipe 9 into the dust filter bag 10. In the dust filter bag 10, the dusts are filtered out, and thereby only clean air is passed through the fan motor 4 and exhausted out of the slits 12. The main rotating brush 23 and the auxiliary brushes 33 serve to brush the dusts out of the carpet and into the suction air.

Next, how the auxiliary rotating brushes 33 operate is described. The auxiliary rotating brushes 33 are disposed in the apertures 32 of the nozzle case 15 so the tips of the brushes 35 project slightly beyond or are flush with the sides of the nozzle case 15 so that the dusts on the edges or corners of the carpet adjacent a wall in the room are brushed up. Therefore, no part of the carpet is uncleaned.

The apertures 32 are provided in both sides of the nozzle case 15 unlike the bottom of the nozzle mouth 21. In general, the performance of a floor nozzle is determined by quantity of suction air passing through nozzle mouth. The provision of the apertures 32 which do not face the carpet forms another current of suction air, namely a bypass of air. Therefore, the quantity of suction air passing through the nozzle mouth 21 is decreased, and thereby the performance of the floor nozzle 2 is lowered. However, since the auxiliary rotating brushes 33 are positioned in the way of suction air flowing through the apertures 32, such air flow is restricted to such a negligible quantity that there is substantially no lowering of the performance of the floor nozzle 2. The dusts which are brushed off by the auxiliary rotating brushes 33 are carried by the current of suction air from a lower part of the compartments 31, via vents 36, to the suction compartment 19. The guide walls 37 aid the flowing of the dusts to the vents 36. Thus, the floor nozzle 2 of this invention enables complete cleaning of any edges and corners of a carpet adjacent a room wall with high performance for sucking dusts. In the above embodiment, although the auxiliary rotating brushes 33 are provided on both sides of the nozzle case 15, an auxiliary rotating brush 33 may be provided on only one side. Further, the floor nozzle 2 having the auxiliary rotating brush 33 is applicable not only to an upright type vacuum cleaner but also to a vacuum cleaner whose body is connected with a floor nozzle via a hose and a pipe.

Figure 6:
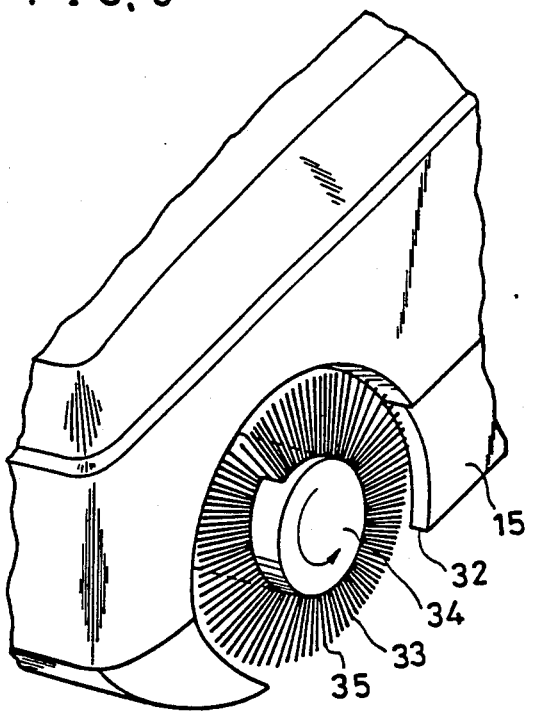
FIG. 6 is an enlarged fragmentary perspective view of a portion of the floor nozzle shown in FIG. 1.

FIG. 6 shows a partial perspective view of another embodiment of a floor nozzle embodying this invention. In this embodiment plural brushes 35 are arranged spirally on the rotor 34 so as to form a screw that brushes off dusts and flicks them off into the aperture 32. Thus, failure of dust-catching can be decreased. This auxiliary brush 33 also operates as a suction fan, and thereby suction power of the floor nozzle 2 is increased as a whole.

Figure 7:
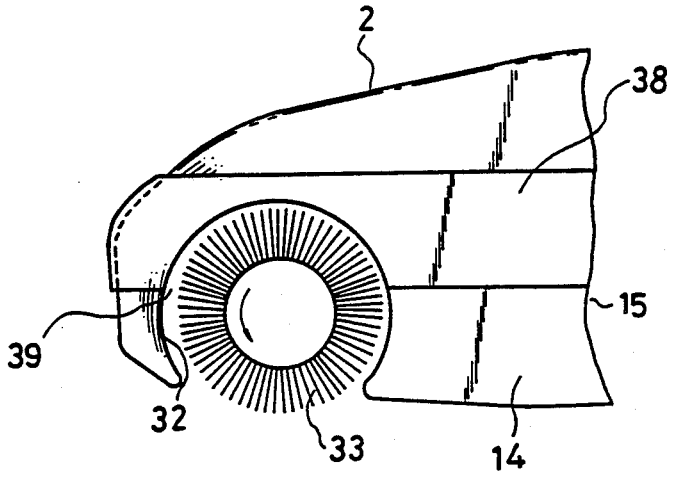
FIGS. 7, 8 and 9 are fragmentary side views of floor nozzles of other embodiments of the present invention.

Hereafter is described, with reference to FIG. 7, another embodiment of the floor nozzle wherein safety against possible injury etc. is improved is described. In this embodiment the center of the auxiliary rotating brush 33 is positioned with a slight shift from the center of the circular aperture 32 toward rear side (right side of FIG. 7), to form a gap 39 between the nozzle case 15 and the brush 33. According to this construction, even if a child inserts his finger into the aperture 32 out of mischief and the finger is caught by the brush 33, the finger is soon released by carrying it into the gap 39. Therefore, injury of the finger is avoidable.

Figure 8:
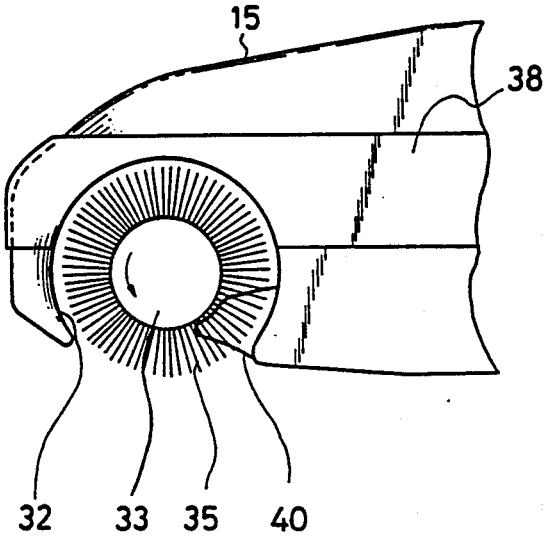

Still another embodiment of the invention is shown in FIG. 8 wherein a rib 40 is provided on the nozzle case 15 so as to project into the lower rear portion of the compartment 31 at the inner side of the auxiliary rotating brush 35. According to this construction, even if a child inserts his finger into the aperture 32, the rib 40 prevents the finger from catching in. Therefore, high safety can be presented.

Figure 9:
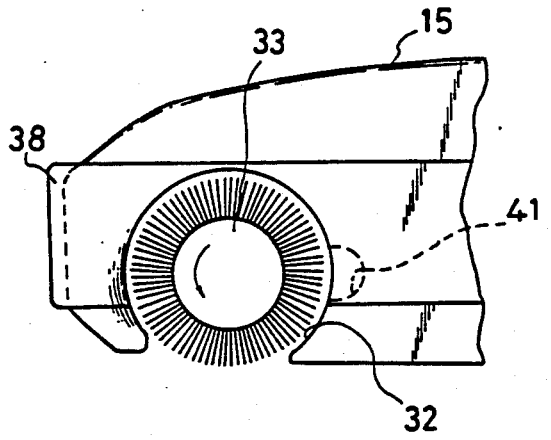

Still another embodiment is shown in FIG. 9 wherein a notch 41 is formed in the nozzle case 15 at the rear edge of the aperture 32. This notch 41 is covered exteriorly by the bumper 38 which is made of an elastic material such as rubber. According to this embodiment, even if a child inserts his finger into the aperture 32 and the finger is caught by the auxiliary rotating brush 33, the finger is released from the brush 33 into the notch 41 by deformation of the bumper 38. Thereby, injury of the finger is prevented. Also, since the notch 41 is usually covered by the bumper 38, there is no increase of the bypassing suction air which would lower the performance of the floor nozzle.

Figure 10:
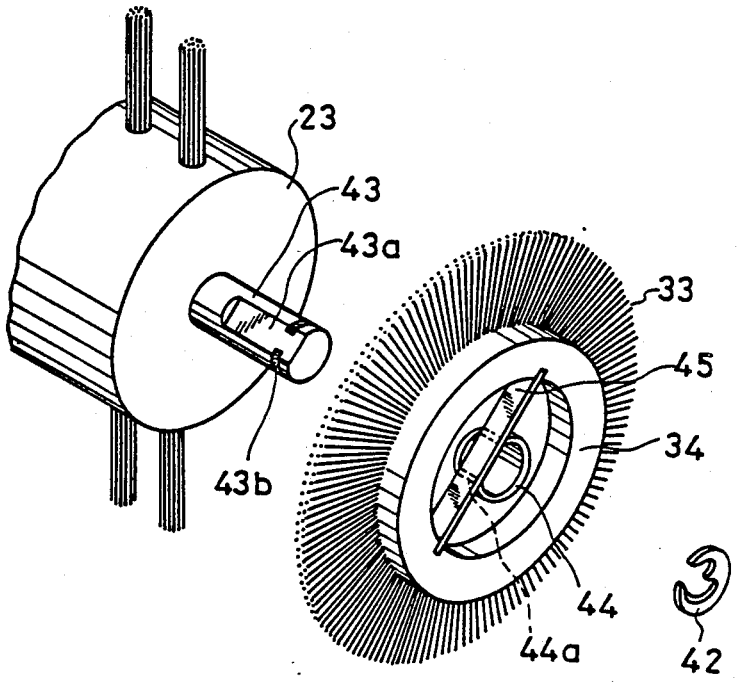
FIG. 10 is an exploded fragmentary perspective view showing an auxiliary rotating brush of still another embodiment of the present invention.

The auxiliary rotating brush 33 may sometimes catch the edges of a carpet, and become jammed and locked thereby. In this state, the fan motor becomes overloaded and may be damaged by overheating thereof or the belt 30 may be burned off by slipping on the spindle 29 (FIG. 3). Still another embodiment to cure this difficulty is shown in FIG. 10. The main rotating brush 23 has a shaft 43 whereon a longitudinal plane part **43*a* and a circumferential groove 43*b* are formed. The rotor 34 of the auxiliary rotating brush 33 has a cylindrical boss 44 with a cut-off part 44*a* thereon. A leaf spring 45 is held at both ends thereof by the rotor 34 and pushes on the cut-off part 44*a*. When the rotor 34 is pushed onto the shaft 43 so that the cylindrical boss 44 fits thereon with and the leaf spring 45 bearing on the plane part 43*a*. A C shaped snap ring 42 is inserted in the groove 43*b* to retain the rotor 34 on the shaft 43. Normally, the auxiliary rotating brush 33, hence the rotor 34, is driven by a torque which is transmitted via the leaf spring from the shaft 43, and thereby the auxiliary rotating brush 33 rotates together with the main rotating brush 23. When the auxiliary rotating brush 33 is locked by catching the edges of a carpet and thereby a required torque to drive it rises above a predetermined value, continued rotation of the shaft 43 deforms the leaf spring 45 and the shaft 43 is disconnected from the auxiliary rotating brush 33**.

Thereby, the main rotating brush 23 can continue to rotate alone. That is, the leaf spring 45 serves as a torque limiter which protects the fan motor 4 (FIG. 3) or the belt 30 (FIG. 3) from damage by locking of the auxiliary rotating brush 33.

Figure 11:
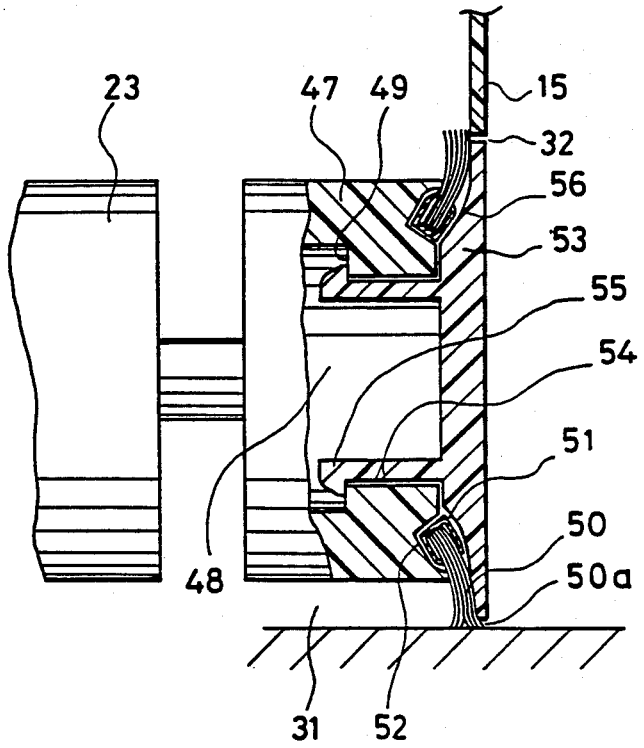
FIG. 11 is a fragmentary vertical sectional view showing an auxiliary rotating brush of still another embodiment of the present invention.

FIG. 11 shows still another embodiment of the auxiliary rotating brush wherein the rotor 47 has a circular bore 48 therein with a step 49 intermediate the ends thereof. An auxiliary rotating brush 50 is held tightly in an annular channel member 51, and this member is received in a circular groove 52 which is formed in the end of the rotor 47 with a predetermined inclination. A cap 53 which conforms to the aperture 32 has a reduced hook 55 that is inserted into the rotor 47 and engages with the step 49 to retain the cap on the rotor 47. The channel member 51 is fixed between the groove 52 and a tapered annular surface 56 which is formed on the cap 53, and thereby the brush 50 is aligned toward the periphery beyond that periphery, and tips 50*a* of the brush 50 project slightly out of the circumference of the cap 53. According to this embodiment, since almost all of the aperture 32 is covered by the cap 53, safety is remarkably improved and the bypassing suction air can be minimized. Further, since the tips 50*a* of the brush 50 reach the carpet beyond the periphery of the cap 53, even the dusts on the edges of the carpet adjacent a room wall are completely brushed and cleaned. Furthermore, when the brush 50 is worn, it can be exchanged easily by removing the cap 53 from the rotor 47.

While specific embodiments of the invention have been illustrated and described herein, it is realized that other modifications and changes will occur to those skilled in the art. It is therefore to be understood that the appended claims are intended to cover all modifications and changes that fall within the true spirit and scope of the invention.

We claim:

1. A floor nozzle for a vacuum cleaner comprising:

a nozzle case having sides, a bottom, a suction compartment therein, an elongated nozzle mouth in said bottom extending between said sides and opening to said compartment and a notch-like aperture in one of said sides extending upward from the lower edge thereof at one end of said mouth;

a main brush rotatably mounted in said compartment with its axis generally coaxial with said aperture and its tufts extending through said mouth and slightly therebeyond;

at least one auxiliary brush in said compartment connected by torque limiting means to one end of said main brush and rotatable therewith with the tips of the tufts of said auxiliary brush rotating closely adjacent at least a major portion of the edge of said aperture; and means for rotating said main brush.

2. The nozzle defined by claim 1 wherein the torque limiting means comprises a shaft extending coaxially from said main brush and having a longitudinal plane surface on one side thereof, a coaxial cylinder on the auxiliary brush fittable on said shaft and detent means associated with said cylinder engageable with said plane surface.

3. A floor nozzle for a vacuum cleaner comprising:

a nozzle case having sides, a bottom, a suction compartment therein, an elongated nozzle mouth in said bottom extending between said sides and opening to said compartment and a notch-like aperture in one of said sides extending upward from the lower edge thereof at one end of said mouth, the entire edge of said aperture being substantially arcuate;

a main brush rotatably mounted in said compartment with its axis generally coaxial with said aperture and its tufts extending through said mouth and slightly therebeyond;

at least one auxiliary brush in said compartment connected to one end of said main brush and rotatable therewith with the tips of the tufts of said auxiliary brush rotating closely adjacent substantially the entire edge of said aperture to substantially eliminate airflow between the brush tips and the edge of the aperture; and means for rotating said main brush.

4. The nozzle defined by claim 3 including a circular cap detachably coaxially mounted to the end of the auxiliary brush to retain the tufts thereon and to substantially cover the aperture.

5. The nozzle defined by claim 4 wherein the cap has an inner tapered annular surface engaging the tufts of the auxiliary brush.

6. The nozzle defined by claim 4 wherein the cap is disposed in the aperture with its periphery closely adjacent the edge of said aperture.

7. The nozzle defined by claim 3 includng means sectioning the compartment into main and auxiliary compartments with a vent therebetween, the main and auxiliary brushes being disposed respectively in said main and auxiliary compartments, and means in said auxiliary compartment separate from said auxiliary brush for guiding dust-laden suction air to said vent.

8. The nozzle defined by claim 7 wherein the tufts of the auxiliary brush are arranged spirally thereon about the axis thereof to mechanically move dust into the auxiliary compartment.

9. The nozzle defined by claim 3 wherein the tufts of the auxiliary brush are arranged in a substantially conical configuration with the concavity thereof facing outwardly of the aperture.

10. A floor nozzle for a vacuum cleaner comprising:

a nozzle case having sides, a bottom, a suction compartment therein, an elongated nozzle mouth in said bottom extending between said sides and opening to said compartment and a notch-like aperture in one of said sides extending upward from the lower edge thereof at one end of said mouth;

a main brush rotatably mounted in said compartment with its axis generally coaxial with said aperture and its tufts extending through said mouth and slightly therebeyond;

at least one auxiliary brush in said compartment connected to one end of said main brush and rotatable therewith with the tips of the tufts of said auxiliary brush rotating closely adjacent at least a major portion of the edge of said aperture;

means for rotating said main brush; and means for preventing fingers from being caught in the auxiliary brush.

11. The nozzle defined by claim 10 wherein the preventing means comprises a rib extending forward from the rear wall of the compartment.

12. The nozzle defined by claim 10 wherein the preventing means comprises a gap between the tuft tips of the auxiliary brush and a portion of the edge of the aperture.

13. The nozzle defined by claim 10 wherein the preventing means comprises a notch in the edge of the aperture.

* * * * *